United States Patent [19]

Ramser et al.

[11] Patent Number: 4,548,768

[45] Date of Patent: Oct. 22, 1985

[54] METHOD FOR THE PRODUCTION OF ATOMIZED METAL PARTICLES

[75] Inventors: Robert A. Ramser; A. David Booz, both of New Kensington; Daniel R. Barch, Natrona Heights; Walter S. Cebulak, New Kensington, all of Pa.

[73] Assignee: Aluminum Company of America, Pittsburgh, Pa.

[21] Appl. No.: 595,683

[22] Filed: May 3, 1984

Related U.S. Application Data

[62] Division of Ser. No. 413,514, Aug. 31, 1982, Pat. No. 4,464,103.

[51] Int. Cl.[4] ..... B29C 6/00

[52] U.S. Cl. ..... 264/12; 264/6; 264/39; 425/7; 425/225; 425/226

[58] Field of Search ..... 264/6, 12, 39; 425/7, 425/225, 226

[56] References Cited

U.S. PATENT DOCUMENTS

| | | | |
|---|---|---|---|
| 2,638,627 | 5/1953 | Golwynne | 264/12 |
| 2,638,630 | 5/1953 | Golwynne | 264/12 |
| 3,293,334 | 12/1966 | Bylund et al. | 264/12 |
| 3,695,795 | 10/1972 | Jessick | 264/12 |
| 3,891,730 | 6/1975 | Wessel et al. | 264/12 |
| 3,966,374 | 6/1976 | Honnorat et al. | 425/7 |
| 4,104,342 | 8/1978 | Wessel et al. | 264/12 |
| 4,177,026 | 12/1979 | Honnorat et al. | 264/12 |
| 4,439,379 | 3/1984 | Hart | 264/12 |
| 4,457,881 | 7/1984 | Booz et al. | 264/12 |

FOREIGN PATENT DOCUMENTS

| | | | |
|---|---|---|---|
| 1383764 | 2/1975 | United Kingdom | 264/12 |

*Primary Examiner*—Jeffery Thurlow
*Assistant Examiner*—Patrick M. Dailey
*Attorney, Agent, or Firm*—Andrew Alexander; John P. Taylor

[57] ABSTRACT

Apparatus is provided for the production of atomized metal comprising a containment vessel having a sidewall terminating in a bottom plate through which atomizing gas and molten metal from a molten metal source external to said vessel enter said vessel through nozzle means sealed thereto. An air ingress port is provided in the vessel spaced from said bottom plate; the sidewall and bottom plate cooperating with said nozzle means to seal off the interior of the vessel and the metal particles therein from the area adjacent the source of molten metal; thereby providing an essentially closed vessel, particularly with respect to the area in which the nozzle means are mounted.

10 Claims, 9 Drawing Figures

METHOD FOR THE PRODUCTION OF ATOMIZED METAL PARTICLES

This is a division of application Ser. No. 413,514, filed Aug. 31, 1982, now U.S. Pat. No. 4,464,103.

BACKGROUND OF THE INVENTION

This invention relates to the production of atomized metal powder and more particularly to improved apparatus for the production of atomized metal powder in a safer and more efficient manner.

The production of atomized powder of metals such as aluminum, magnesium, copper, bronze, zinc and tin and the like carries with it the attendant risk of explosion.

Conventionally, therefore, atomized metal powder is produced using a containment or chilling chamber into which the atomized metal stream is injected through an open end of the chamber positioned adjacent the atomizer and a liquid metal reservoir, the atomized metal stream being cooled or chilled with air introduced through the open end by a down stream exhaust fan. Such a system can result in safety hazards because any explosion occurring in the system can propogate backwards to the open ended chiller chamber, often exposing operating personnel to hazardous conditions. Furthermore, the release of resultant burning aluminum particles with intense heat radiation through the open end of the containment vessel upon occurrence of an explosion can also result in further safety hazards.

The present invention solves the problems in the prior art by providing a system which contains the gases and burning particles should an explosion occur.

SUMMARY OF THE INVENTION

It is, therefore, an object of the invention to provide apparatus for the production of atomized metal which will mitigate and contain the effects of uncontrolled oxidation reactions by the atomized metal particles.

It is another object of the invention to provide apparatus for the production of atomized metal which will inhibit the occurrence of uncontrolled oxidation reactions by the atomized metal particles.

It is yet another object of the invention to provide apparatus for the production of atomized metal particles which will monitor the amount of gas entering the apparatus.

It is a further object of the invention to provide means for filtering gases, including air, entering the atomizing apparatus to enhance the purity of the product and minimize the oxidizable solids.

It is yet a further object of the invention to provide means for controlling the temperature within the atomizing apparatus.

It is another object of the invention to provide means for directing the flow path of gases with the atomizing apparatus.

It is yet another object of the invention to provide means for detachably coupling the source of molten metal with the atomizing apparatus in sealing relationship.

These and other objects of the invention will become apparent from the description and accompanying drawings.

In accordance with this invention there is provided an apparatus for the production of atomized metal comprising a containment vessel having a sidewall terminating in a bottom plate through which atomizing gas and molten metal from a molten metal source external to said vessel enter said vessel through nozzle means sealed thereto. A restricted air ingress port is provided in the vessel spaced from said bottom plate; the sidewall and bottom plate cooperating with said nozzle means to seal off the interior of the vessel and the metal particles therein from the area adjacent the source of molten metal; thereby providing an essentially closed vessel, particularly with respect to the area in which the nozzle means are mounted.

DETAILED DESCRIPTION OF THE PREFERRED EMBODIMENTS

Figure 1:
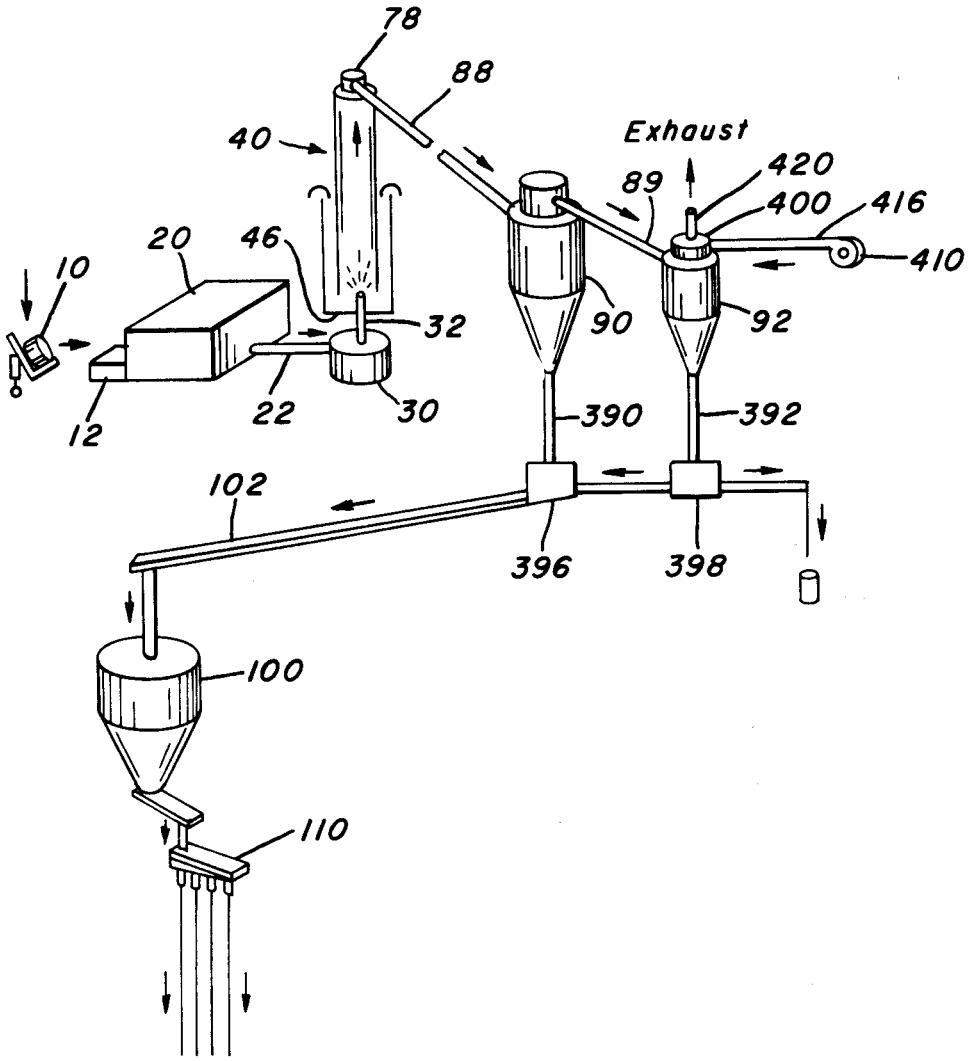
FIG. 1 is a schematic flowsheet of the atomized metal product apparatus.
Figure 1A:
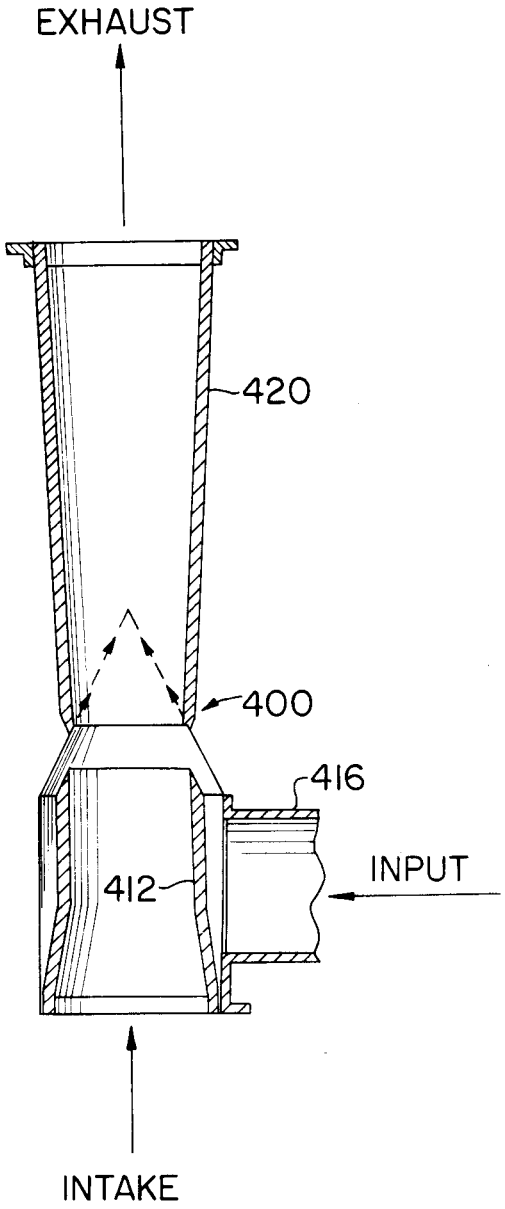
FIG. 1A is a vertical cross section of a portion of the apparatus of FIG. 1.

Referring now to the drawings, FIG. 1 illustrates, schematically, the apparatus for producing and handling atomized metal powder from molten metal which may be provided from a molten metal crucible 10 or an ingot 12 which is charged to a holding/melting furnace 20 connected via duct 22 to a reservoir 30 beneath containment vessel 40. One or more atomizing nozzles 32 are mounted to the bottom plate 46 of vessel 40 to provide communication with the molten metal in reservoir 30.

The atomized metal produced in vessel 40 is swept out of vessel 40 through duct 88 to primary cyclone separator 90 which passes the coarse particles to powder tank 100 via conveyor 102. Finer particles, including fines, are removed from the air stream in one or more secondary cyclone separators 92 from whence they may be passed to powder tank 100 or separately packaged. The fines may be packaged separately or reblended with the coarser particles. It should be noted in this regard that various classified particle streams emanating from separator 110 may also be blended together in any predetermined amounts or ratios.

The atomized powder, preferably kept under an inert gas blanket after separation, is classified at screening station 110 for packaging and distribution in various particle size ranges.

Figure 2:
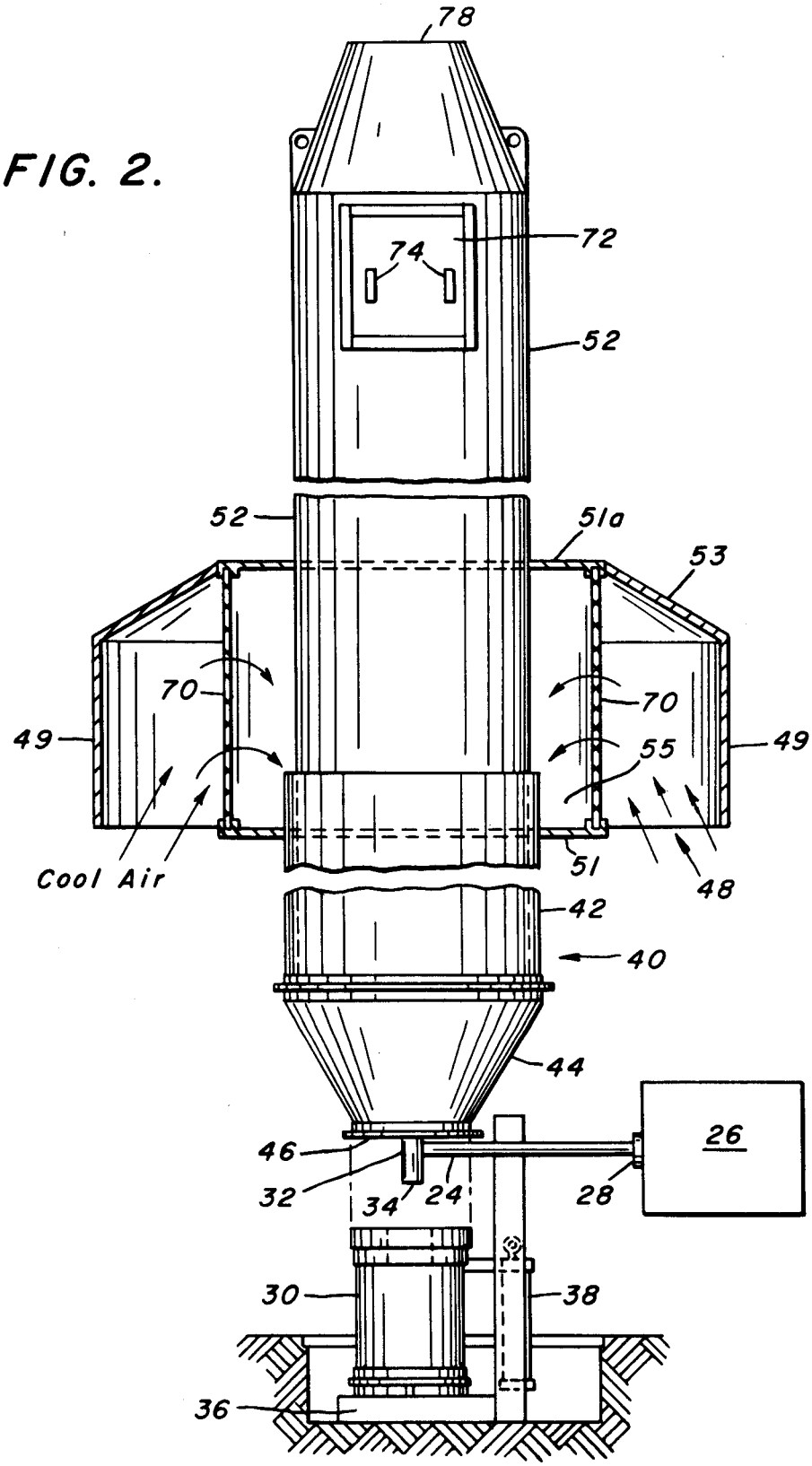
FIG. 2 is a side view in section of the containment vessel.
Figure 3:
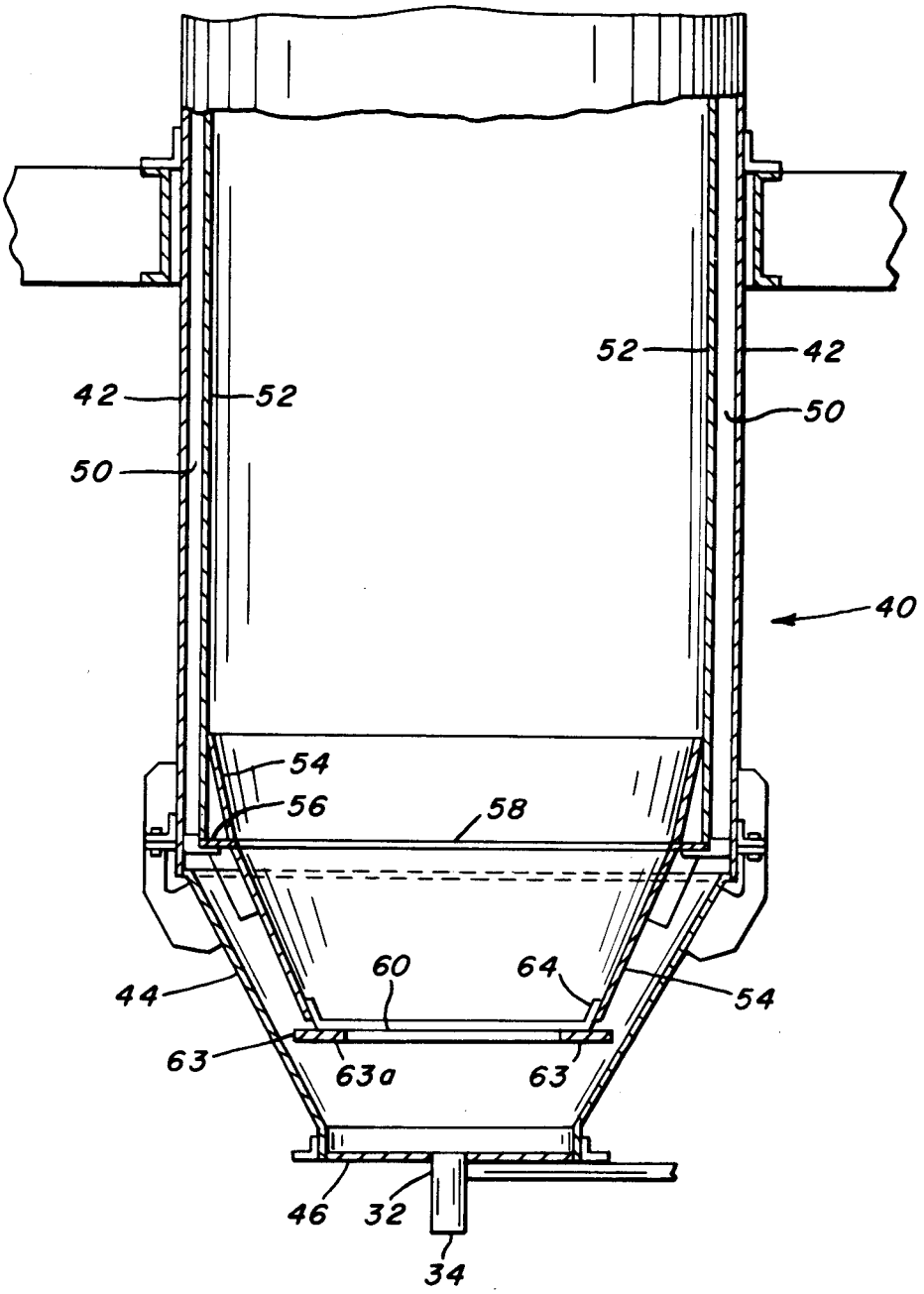
FIG. 3 is a side section view of the lower portion of the vessel shown in FIG. 2.

Containment vessel 40, as shown in more detail in FIGS. 2 and 3, comprises an outer cylindrical shell 42 terminating at its lower end in a truncated cone 44 to which is mounted bottom plate 46 which carries nozzles 32. Bottom plate 46 seals off the end of cone 44 except for the openings for nozzles. This provides essentially a closed containment vessel or chiller chamber 40, particularly with respect to the area in which the nozzles are mounted.

Shell 42 is provided with a open upper end 48 which provides an air entry for the cooling and collecting gases, e.g. air, introduced into containment vessel 40 in accordance with the invention, as will be described below.

Still referring to FIG 2, molten metal reservoir 30 may be mounted below vessel 40 on a platform 36 which may be raised and lowered by mechanism 38 to facilitate changing or servicing nozzle 32.

Nozzle 32 is removably mounted to the lower side of bottom plate 46 in a manner to be described which facilitates removal of nozzle 32. Nozzle 32 is provided with a center bore through which flows molten metal to be atomized. The lower end 34 of nozzle 32 is immersed in the molten metal in reservoir 30 when the reservoir is in its raised position as shown in the dotted lines. Air, under pressure, enters nozzle 32 via tube 24 and is emitted adjacent the central bore at the upper end of the nozzle to atomize the molten metal. Atomizer portion of nozzle 32, which forms no part of the present invention, may be constructed in accordance with well known principles of atomization construction such as, for example, shown in Hall U.S. Pat. No. 1,545,253.

Tube 24 is detachably connected to a manifold 26 through a quick-disconnect seal fitting 28 (See FIG. 2) to facilitate easy removal of tube 24. Manifold 26 serves to provide an even pressure distribution when a plurality of nozzles are used.

Nozzle 32, if used singly, may be coaxially positioned in vessel 40 to permit central current flow of the gases and metal particles. If a plurality of nozzles are used, they may be concentrically mounted about the axis of vessel 40 for the same reason, or for convenience in handling, may be mounted in rows.

Concentrically mounted within the lower part of outer cylindrical shell 42 is a second cylinder 52 (FIG. 3) of sufficiently smaller outer diameter to define an annular passageway 50 between cylinders 42 and 52. In FIG. 3, it will be seen that cylinder 52 is provided at its lower end with a conical member 54 which may be welded or fastened at 56 to a ring 58 which may be, in turn, welded or fastened to the end of cylinder 52. Fastened to the lower end of conical member 54 is a ring 60 which is spaced or suspended below the lower end of conical member 54 to provide an opening therebetween. Ring 60 has an outer edge portion 63 which protrudes into the extension of annular passageway 50 defined by the walls of truncated cone 44 and conical member 54. Outer edge portion 63 serves to flow or channel air into vessel 52 for purposes to be explained later. Referring again to FIG. 3, it will be seen that ring 60 may be suspended from truncated member 54 by members 64.

Cool air is pulled into vessel 40 by eductor means 400, for example, shown in FIG. 1. The air enters the annular opening 48 (FIG. 2) of outer cylinder 42, passes through filters 70 into annular passageway 50 and into the bottom of vessel 40 adjacent nozzles 32. This cool air, passing through annular passageway 50, at a velocity in the range of about 1000 to 6000 ft/min, serves to keep the inner wall of vessel 40, i.e. the wall of cylinder 52, cool, thereby inhibiting particle deposition thereon.

Annular opening 48 is defined by a side shield member 49 and annular ring 51. Side shield member 49 is supported and fastened to annular ring **51*a* and top member 53, which in turn are secured to vessel 40 to prevent water or other materials being ingested during operation, particularly when this part of the vessel is exposed to the atmosphere. It will be appreciated that during operation, in one embodiment, large volumes of air are ingested through opening 48 for cooling the walls of the chiller chamber of containment vessel 40 and for purposes of carrying the atomized powder out of the vessel. From FIGS. 2 and 3, it will be seen that the annular passageway 50 between inside vessel 52 and outside vessel 42 opens into annular opening 48. It is preferred that outside vessel 42 extends above annular ring 51 to provide a trap 55 for water that may pass through filter 70**.

Filters 70 may be any conventional filters used for filtering air and are disposed annularly around the periphery of rings 51 and **51*a*** and secured thereto by conventional means.

It should be noted that the intake has been shown as spaced apart from both the bottom plate and nozzles to provide an isolation of the air intake from the nozzle and external molten metal to mitigate hazardous conditions. Other structural configurations to accomplish this result can also be used, such as one-way check valves or other labyrinth structures.

In another aspect of the invention, it has been found that the temperature of cylinder wall 52 is important. That is, it has been found that if the temperature of the wall is permitted to substantially exceed 300° F., the molten metal, e.g. aluminum, in atomized form has a tendency to stick or become adhered to the cylinder wall in substantial quantities and subsequently break loose, causing unsafe conditions. Accordingly, it has been found, for example with respect to aluminum, that sticking is minimized or is virtually eliminated by lowering the wall temperature of cylinder 52 to preferably less than 250° F. with a typical temperature being less than 225° F. The temperature of the wall of cylinder 52 can be lowered by the collection air introduced at annular opening 48.

To provide for cooling of the walls by using collection air, the materials used in construction of the inner cylinder wall 52 should be selected with heat transfer characteristics as well as more conventional corrosion characteristics in mind. For example, it is preferred that materials such as copper, aluminum and stainless steel and the like with or without chrome plating can be selected.

In yet another embodiment of the invention respecting deposition of atomized particles on the wall of cylinder 52, it is preferred that the roughness of such wall be controlled. That is, the rougher the wall surface is, the greater the tendency is for atomized metal particles, e.g. aluminum, to stick or adhere to the surface. Thus, in one embodiment, the surface should have a roughness of not greater than about 100 to 150 microns RMS and preferably not greater than 60 microns RMS with the finish lines preferably in the direction of flow.

As well as providing a controlled surface roughness, it can also be advantageous to prepare or treat the surface with a release agent to further minimize the tendency of atomized particles to stick thereto. Accordingly, it has been found that treating the surface with a release agent selected from the class consisting of waxes and polymeric materials further inhibits the adherence of metal particles thereto. When a wax is used, it has been found that DO-ALL TOOL SAVER, which is available from the DO-ALL Tool Company, provides a finish on the wall of cylinder 52 which is resistant to deposition of atomized aluminum particles when the temperature of the wall is less than 300° F., preferably in the range of about 200°0 to 250° F.

The molten metal in reservoir 30 is initially aspirated therefrom through nozzle 32 by means of the atomizing gas introduced to the nozzle. The atomizing gases, either hot or cold, may be inert gases or other gases. Similarly, the collecting gases may be either hot or cold (but preferably cold), and may be either inert gases or other gases provided with a predetermined amount of oxidizing gases to provide a minimum protective oxidation layer on the particle surface. This minimizies any subsequent oxidation reactions upon exposure to air. Additionally, the collecting gas may be air. The collecting gases used in accordance with the invention may be used to both cool and sweep the metal particles out of containment vessel 40.

Because of the flow pattern that develops as the metallic particles are swept upwardly in containment vessel 40, some particles gravitate towards the vessel wall and fall back towards the atomizers. The particles which fall back can interfere with the atomization if they are permitted to accumulate on bottom plate 46 as well as promote unsafe accumulations. Therefore, ring 60 is provided with an outer edge portion 63, as noted above, which protrudes into the portion of the annular passageway 50 between truncated cone 44 and conical member 54. Outer edge portion 63, because it is spaced below conical member 54, redirects and draws in some of the air (e.g. as much as one third of the air being drawn down between the outer and inner vessels to flow into vessel 40) between portion 63 and conical member 54. This redirected air drawn in by outer edge portion 63 sweeps metal particles which fall down the inner vessel wall back into the mainstream of metal powder being swept out of the container.

It should be noted that inner portion 63*a* of ring 60 acts as a deflector for larger particles to aid in sweeping such particles into the main stream. In this way, such metal particles are prevented from accumulating at the bottom of the vessel and interfering with the atomizing process.

Inner cylinder 52, which comprises the inner wall of vessel 40, tapers at its upper end into an exit port 78 permitting the metal particles egress to duct 88 which carries them to cyclone separator 90. The upper portion of cylinder 52 may also be provided with one or more pressure relief hatches 72 releasably mounted on and forming a portion of the wall of cylinder 52. Preferably, such hatches, when used, are releasably attached to cylinder wall 52 by a restraining means such as hinge means to inhibit the hatch from blowing away upon a sudden buildup in pressure.

While the foregoing description of atomizing apparatus has been made with respect to an updraft vertically mounted vessel, it will be appreciated that the invention has application to horizontally disposed vessels or downdraft vessels.

The metal atomizing apparatus of the invention is further characterized by means to facilitate cleaning or removal and replacement of the atomizing nozzle. Such means can be particularly useful if a plurality of nozzles are used in the apparatus and it is desired to either clean out or replace one of the nozzles while continuing to operate the apparatus using the remainder of the nozzles.

During operation of the atomizing apparatus, the liquid metal flowing through nozzle 32 can decrease the size of the bore in the nozzle due to metal and metal compounds, e.g. contaminants, collecting on the wall of the nozzle bore. Accordingly, such decrease in bore size can change the particle size obtained during atomization and as a result, it can be difficult to maintain a constant particle size distribution. Thus, it will be appreciated that it is desirable to maintain the nozzle bore in a condition which prevents particle size distribution from changing. While the nozzle may be sealed off and replaced, provision has been made, in accordance with the invention, for in situ purging or cleaning of the nozzle to bring it back to substantially the original bore size.

In this aspect of the invention, the nozzles may be purged or cleaned in several different ways. For example, in reference to FIG. 5, there is shown one embodiment of an apparatus which in accordance with the invention permits cleaning or purging of the nozzles. That is, in FIG. 5, there is shown bottom plate 46 having a nozzle 32 projecting therethrough. Nozzle 32 has an upper end 33 which projects into a dished-out portion 37 in plate 46. It will be understood that in operation, an atomizing gas such as compressed air is introduced to nozzle 32 to aspirate and atomize molten metal therethrough while outside air is drawn in through the annular opening 48 to collect or sweep the atomized metal out of the containment vessel. Thus, during the atomizing operation, for purposes of cleaning or purging the nozzle, in this embodiment, both sources of air or gas remain turned on. For purposes of cleaning during operation, there is provided an arm 350 carried in a ball 360 mounted in the wall of the containment vessel which can be operated from outside the vessel.

Arm 350 is provided or has fastened thereto a plate or cover 352 which can cover nozzle 32 from the remainder of vessel 40. Thus, for purposes of cleaning, purging plate or cover 352 is placed over nozzle 32 for purposes of redirecting compressed air or gas used for atomization purposes down through the molten metal conduit of the nozzle, thereby cleaning out any material interfering with the flow of molten metal through the nozzle. The redirected gases may be pulsed by momentary applications of the cover over nozzle 32.

Figure 4:
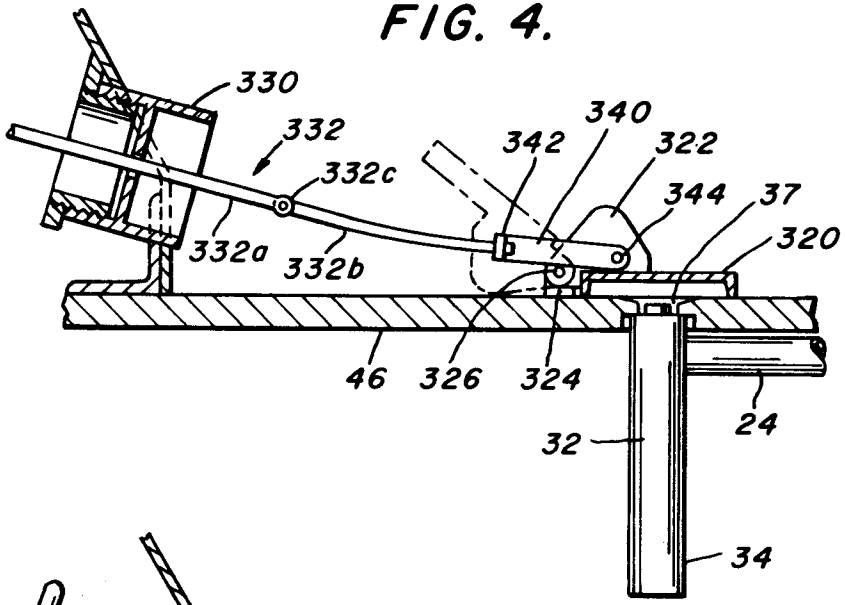
FIG. 4 is a fragmentary side section of the apparatus showing one embodiment of the purging mechanism.

In another embodiment of this aspect of the invention, there is shown in FIG. 4 a cover which may be utilized for purposes of removing the atomizing nozzles, as noted above. In this embodiment, the air for collecting can remain turned on. However, the compressed air for atomizing should be cut back substantially if it is used to clear the nozzle. Further, in this embodiment, lid 320 is mounted to bottom plate 46 via an arm 322 on lid 320 which is pivotally attached to bracket 324 at 326. Lid 320 is moved between the open and shut positions by shaft 332 which may be activated by an air cylinder 330. Shaft 332 is connected to arm 322 of lid 320 and comprises hinged portions 332*a* and 332*b* joined at 332*c*. Shaft 332 is, in turn, pivotally attached to lid 320 by an arm 340 which is pivotally attached to shaft 332 at 342 and to arm 322 at 344.

To open lid 320, shaft 332 and arm 340 are pulled toward cylinder 330 causing arm 322 to rotate about pivot 326 moving lid 320 into an open position as shown by the dotted lines in FIG. 4. This is the normal position for lid 320 during operation of the atomizing process. However, when it is necessary to remove or clean nozzle 32, arm 322 is pushed towards the nozzle to close lid 320 thereby sealing off nozzle 32. This diverts the compressed air used for atomizing, forcing it down the central molten metal conduit of the nozzle and cleans or removes any foreign material in the same way as referred to above.

If it is desired to replace a nozzle instead of cleaning, then the compressed air used for atomizing purposes should be turned off in both embodiments described above. Lid 320 in the closed position permits nozzle 32 to be removed or serviced without shutting down the apparatus or creating an undesirable opening into vessel 40 which may upset the air flow balance.

Figure 5:
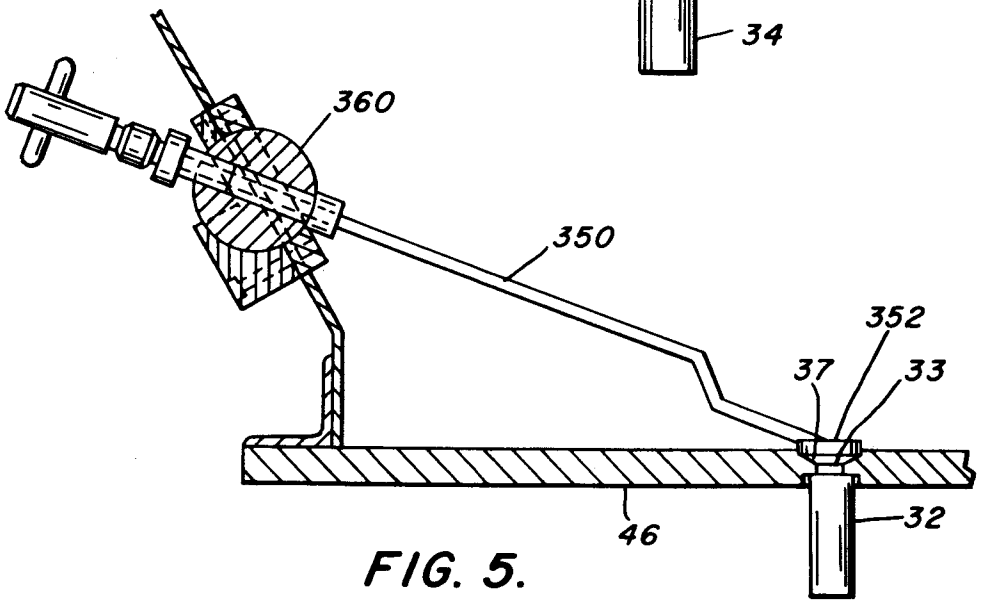
FIG. 5 is a fragmentary side section of the apparatus showing another embodiment of the purging mechanism.

While FIGS. 4 and 5 have illustrated the nozzle purging mechanism for a single nozzle for simplicity of illustration, it should be noted that the mechanism finds it greatest utility when used in a multi-nozzle system wherein each nozzle mounted to bottom plate 46 is fitted with such a nozzle purging mechanism.

Figure 6:
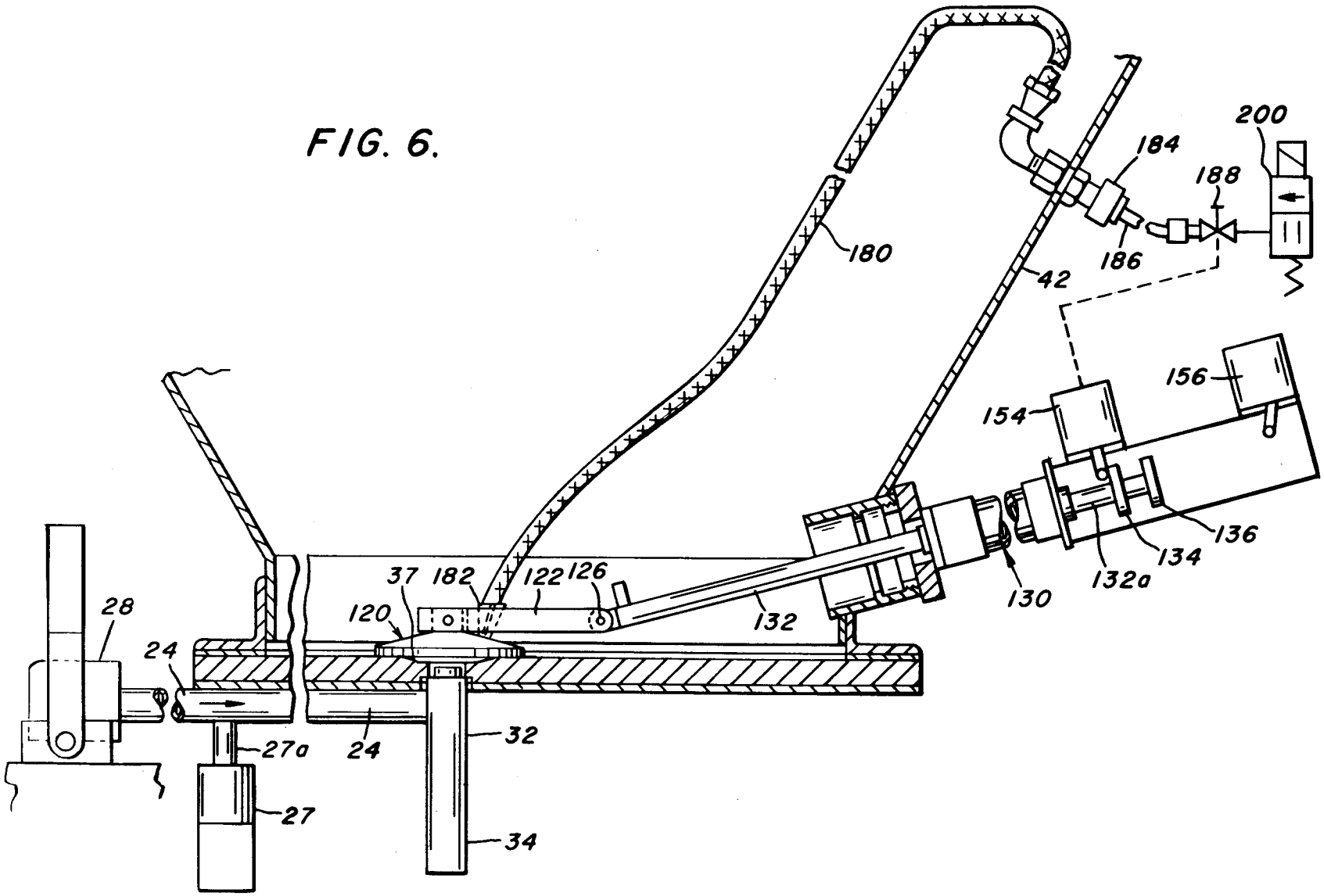
FIG. 6 is a fragmentary side-sectional view of the apparatus showing a third embodiment of the purging mechanism.

As shown in FIG. 6, the purging can be carried out in another manner with the use of an external source of purging gas via a hose attached to cover 120. In this embodiment, the underside of cover 120 provides a passageway from the hose 180 to the central bore for carrying molten metal in nozzle 32. Cover 120 is moved over nozzle 32, and the pressure of the purging gas is then used to clean undesirable deposits from the bore.

In the apparatus shown in FIG. 6, closure 120 is mounted to be slidably movable into a position over nozzle 32. An arm 122 mounted on lid 120 is pivotally mounted at 126 to a shaft 132 of a fluid cylinder 130 which is used to slidably move lid 120 over nozzle 32. Shaft extension 132*a*, on the opposite end of fluid cylinder 130, may be provided with camming rings or stops 134' and 136 which are used to activate electrical switches 154 and 156. Switch 154, which is activated by stop 134 when fluid cylinder 130 is actuated to close off nozzle 32, controls the flow of purging gas to lid 120, as will be described below. Switch 156 turns on a solenoid valve (not shown) to turn on the flow of atomizing gas to nozzle 32. When shaft 132*a* on fluid cylinder 130 is in its withdrawn position, i.e. when lid 120 is withdrawn from over nozzle 32, switch 156 is turned on by contact with shoulder 136. Switch 156 may be spring loaded to return to the off position (see FIG. 6) when not in contact with shoulder 136. This shuts off the flow of atomizing gas when fluid cylinder 130 is actuated to push shaft 132 into its forward position to slide cover 120 over nozzle 32.

Referring again to FIG. 6, cover 120 is also connected to a flexible hose 180 via a nipple 182 on cover 120. Flexible hose 180 is connected at its opposite end to a fitting 184 mounted in the wall 42 of vessel 40. Pipe 186 connects fitting 184 with an electrically controlled valve 188 which, when activated (via switch 154), permits purging gas to flow from gas source 200 to cover 120.

When fluid cylinder 130 is actuated to slide cover 120 over nozzle 32, shoulder 134 contacts normally off switch 154 turning switch 154 on to open control valve 188 permitting the purging gas to flow into cover 120. Since, concurrently, switch 156 was shut off, thereby shutting off the valve controlling atomizing gas flow to nozzle 32, the purging gas is forced through the central bore for molten metal in nozzle 32, thereby purging the bore.

It should be noted that the system, as shown, can provide a steady or pulsated stream of purging gas by manipulation of the cover. Preferably, in the system a short burst of purging gas is used to clear the bore. Such may be provided by a timing mechanism activated by switch 154 to periodically open valve 188 during the time that cover 120 is over nozzle 32. It will be seen that the atomizing gas is turned off. Further, it will be seen that this system may also be used to change nozzles without interfering with the atomizing process.

While the purging has been described both with regard to a continuous or pulsated flow, it should be noted that the pulsated flow is the preferred embodiment. Furthermore, if the continuous flow is used, care must be exercised in preventing the nozzle from cooling off, which could result in further coating buildups within the nozzle, thereby defeating the entire purpose of the purging operation.

Figure 7:
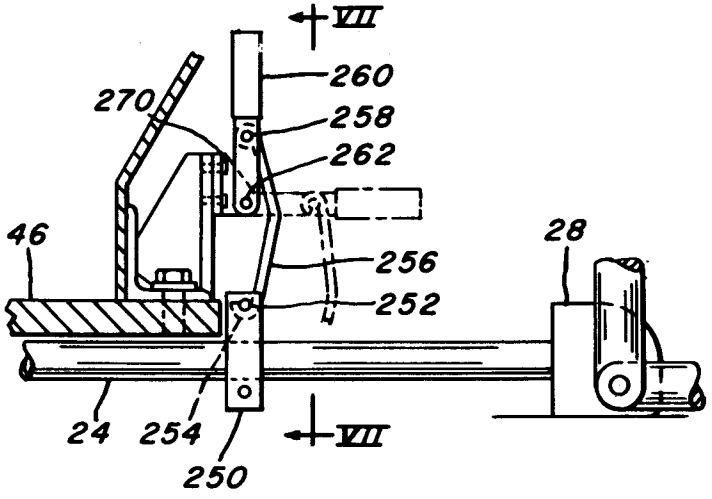
FIG. 7 is a fragmentary side sectional view showing a method of locking the nozzle and compressed air feed in place.
Figure 8:
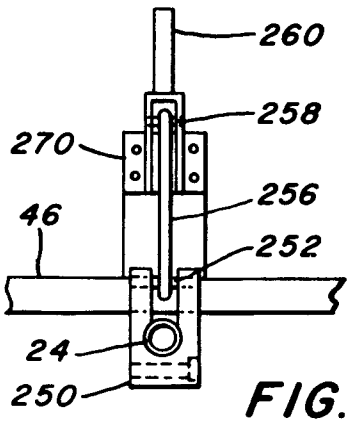
FIG. 8 is an end-section view of FIG. 7 taken along lines VII—VII.

FIGS. 6 and 7 illustrate alternate mechanisms used to mount nozzle 32 and atomizing gas tube 24 to bottom plate 46 of vessel 40 which permits quick disengagement and removal of nozzle 32. In FIG. 7, nozzle 32 is firmly clamped against bottom plate 46 by a clamping mechanism which comprises a clamp 250 on tube 24 with a pin 252. Pin 252 is detachably engaged by a hook 254 on an arm 256 which is connected to a lever 260 at a second pivot point 258. Lever 260 is connected at its fulcrum point 262 to a bracket 270 attached to bottom plate 46. When lever 260 is lowered to the horizontal position shown in the dotted lines, hook 254 can be detached from pin 252 permitting tube 24 and nozzle 32 to be removed as a unit. As mentioned previously, tube 24 slips into quick disconnect fitting 28 which shuts off the flow of atomizing gas when tube 24 is removed, thereby permitting continued operation of the system without loss of atomizing gas.

As shown in FIG. 6, there is provided another method of clamping nozzle 32 and tube 24 firmly to plate 46. In this embodiment, an air cylinder 27 urges shaft 27*a* against pipe 24, thereby securely fixing nozzle 32 against plate 46 for purposes of atomization. It should be noted that, in both embodiments, the underside of plate 46 may be provided with a notch to aid locating and maintaining nozzle 32 in the proper position on plate 46.

In accordance with another aspect of the invention, there is provided a novel means for collecting the particle stream. The novel means comprise an eductor or aspirator which provides or creates a suction effect. As shown in FIG. 1, eductor 400 may be mounted to the last cyclone 92 and connected to one or more eductor blowers 410 which sweep an air stream through duct 416 to eductor 400. The air stream exits to the atmosphere from eductor 400 through exit port 420. Within eductor 400 is a Bernoulli tube which attaches to the discharge side of separator 92. As air is pumped through eductor 400, a vacuum is created in the tube which drops the pressure in cyclone 92. This creates a pulling effect in duct 89 which is passed back through cyclone 90 to duct 88 to vessel 40. Cooling air is thereby sucked into vessel 40 through the opening 48 and annular passageway 50 without any fans in the metal particle gas stream.

An eductor or aspirator suitable for use in this application may be purchased from the Quick Draft Company.

While the system just described utilizes an eductor or aspirator means to create a pulling effect on the system to collect and sweep the atomized particles from vessel 40, it will be understood and deemed to be within the scope of the invention that a pushing system may be used either singly or in combination with the pulling system. For example, fans, or other air-pushing means, such as compressed air or the like, may be connected to opening 48 for purposes of forcing the collecting gases into and through the system. The term "aspirating means" as used herein is defined as pulling collecting gases into the atomizing or cooling chamber without use of mechanical devices, e.g. fans, in the atomized particle stream for drawing the collecting gases and atomized particles through the system. That is, the use of the term "aspirating means" is meant to include means such as devices using Bernoulli tubes, e.g. whereby the collecting gases are drawn through the system. However, it will be understood that devices such as fans or blowers, etc. (external to the atomized particle flow) can be used to force air or gases into Bernoulli tubes and the like for purposes of drawing gases through the atomizing system. It should be further noted, however, that in either of these embodiments, the collecting air is swept through the system without the particles coming in contact with any air-moving means, such as fans or the like. Thereby, the attendant problems with such fans have been successfully avoided in the practice of this invention.

It will be further understood that with the eductor system just described, a subatmospheric condition is created adjacent the nozzles on plate 46. However, with the use of a pushing device, as referred to immediately above, a greater than atmospheric condition can be obtained in vessel 40. Thus, it will be understood that a combination of the push and pull systems may be blended in order to get a controlled atmospheric pressure adjacent the nozzles during operation or slightly above or slightly below if it is desired to operate in these areas, depending to some extent on the type of particle desired.

When conditions are controlled in the chiller chamber to provide greater than atmospheric pressure, e.g. in the push system, the nozzles can be purged by turning off the atomizing gas to the particular nozzle requiring attention. Then, the pressure in the chamber can be sufficient to purge the nozzle of any undesirable deposits.

The production of atomized powder by the apparatus and process of the invention as herein described is thus carried out in a safer and more economical manner. Minor modifications of the herein described embodiments may be apparent to those skilled in the art and is deemed to be within the scope of the invention as defined by the appended claims.

What is claimed is:

1. An improved method for safely producing pyrophoric atomized metal in an open system comprising a containment vessel having a sidewall terminating in a bottom plate through which atomizing gas and molten metal are introduced from sources external to said vessel through nozzle means sealed to said bottom plate; the sidewall, bottom plate, and nozzle means cooperating to seal off the bottom of the vessel from an external source of molten metal adjacent thereto; and a sweeping gas ingress port in said containment vessel is spaced from the sealed off bottom portion of said vessel; the method comprising:

(a) introducing said molten metal into said vessel from said external molten metal source through said nozzle means sealed to said bottom plate in finely divided particles;

(b) introducing sweeping gas into said vessel through said gas ingress port spaced from said bottom plate and said nozzle means; and (c) sweeping said particles from said vessel with said sweeping gas;

whereby the spacing of said sweeping gas ingress port from said bottom plate and said external source of molten metal adjacent thereto will prevent blow back of gas from said vessel into said molten metal during an inadvertent explosion of said particles within said vessel.

2. The method of claim 1 wherein said gas is filtered adjacent said ingress port to prevent solid materials from entering into said vessel.

3. The method of claim 1 wherein said particles are swept from said containment vessel by gas which enters said vessel from said ingress port through a dual wall construction of said sidewall.

4. The method of claim 3 wherein the force of undesirable pressures is relieved by detachable pressure relief hatches carried by said sidewall at a point spaced from said double wall portion of said sidewall.

5. The method of claim 3 including redirecting at least a portion of said gas entering said vessel by baffle means in said passageway to sweep metal particles which fall down the inner vessel wall back into the mainstream of metal powder being swept out of said vessel to prevent metal particle accumulation at the nozzles.

6. The method of claim 3 including the step of directing said sweeping gas from said ingress port through the passageway defined by said dual wall construction of said sidewall and into the bottom of said containment vessel adjacent said nozzles.

7. An improved method of producing atomized metal in an open system which comprises:

(a) introducing atomized metal from an external source of molten metal through atomizing nozzle means into a vessel having a sidewall terminating in an endwall carrying said nozzle means;

(b) sweeping the atomized metal from said vessel with gas introduced into said vessel through an annular passageway formed by a dual wall portion of said sidewall; and (c) filtering said sweeping gas with filtering means adjacent an entrance port to said passageway spaced from said nozzle means and said external source of molten metal.

8. The method of claim 7 which further includes redirecting at least a portion of said gas entering said vessel by baffle means associated with said passageway to thereby sweep any metal particles which fall down along the inner vessel wall back into the mainstream of metal particles being swept out of said vessel.

9. The method of claim 8 which further includes relieving the force of undesirable pressures which may inadvertently build up in said vessel by pressure relief hatch means.

10. The method of claim 7 wherein a source of molten aluminum alloy is provided external to said vessel and in communication with said nozzle means whereby particles of atomized aluminum alloy are introduced into said vessel and swept out by said gas.

* * * * *